US011918845B2

(12) United States Patent
Hsu

(10) Patent No.: US 11,918,845 B2
(45) Date of Patent: Mar. 5, 2024

(54) ROWING EXERCISE MACHINE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 114 days.

(21) Appl. No.: 17/742,068

(22) Filed: May 11, 2022

(65) Prior Publication Data

US 2023/0338772 A1 Oct. 26, 2023

(30) Foreign Application Priority Data

Apr. 21, 2022 (TW) ..... 111204108

(51) Int. Cl.
*A63B 22/00* (2006.01)
*A63B 21/00* (2006.01)

(52) U.S. Cl.
CPC ..... *A63B 22/0076* (2013.01); *A63B 21/153* (2013.01); *A63B 22/0087* (2013.01); *A63B 2022/0084* (2013.01)

(58) Field of Classification Search
CPC .... A63B 22/0087–0089; A63B 21/153; A63B 22/0076–2022/0084
See application file for complete search history.

(56) References Cited

U.S. PATENT DOCUMENTS

2008/0280736 A1* 11/2008 D'Eredita ..... A63B 69/06 482/72
2016/0279464 A1* 9/2016 Liu ..... A63B 21/4047
2018/0056118 A1* 3/2018 Bates ..... A63B 22/0087

FOREIGN PATENT DOCUMENTS

CN 212439861 U 2/2021
TW 201912216 A 4/2019
TW 202112415 A 4/2021
WO WO-2016146480 A1 * 9/2016 ..... A63B 21/00

* cited by examiner

*Primary Examiner* — Jennifer Robertson
(74) *Attorney, Agent, or Firm* — Rosenberg, Klein & Lee

(57) ABSTRACT

A rowing exercise machine includes a base frame, a paddle unit, a first rotating shaft, a paddle linkage unit, a resistance unit, a pull bar unit, a second rotating shaft, and a pull bar linkage unit. When a first operating force is applied to the paddle unit, a paddle one-way driving wheel and the first rotating shaft are driven to rotate in a first rotational direction. When the first operating force disappears, the paddle one-way driving wheel is idling on the first rotating shaft in a second rotational direction. When a second operating force is applied to the pull bar unit, the pull bar linkage unit is driven to rotate in the first rotational direction. When the second operating force disappears, a second return force drives a pull bar one-way wheel to be idling on the second rotating shaft in the second rotational direction.

10 Claims, 19 Drawing Sheets

ROWING EXERCISE MACHINE

FIELD OF THE INVENTION

The present invention relates to an exercise machine, and more particularly to a rowing exercise machine that can provide different exercise modes through paddles or a pull bar.

BACKGROUND OF THE INVENTION

In general, a rowing exercise machine can be operated by paddles or a pull bar. As disclosed in Chinese Utility Model Publication No. CN212439861 on Feb. 2, 2021, a double paddle rowing machine comprises a frame, a resistance system, two foot pedals, two paddles and a seat. The resistance system is disposed at the front end of the frame. The resistance system includes two resistance ropes. The two foot pedals are disposed at both sides of the frame and are rotatably connected to the frame. The bottoms of the two paddles are disposed at both sides of the frame and are rotatably connected to the frame. The upper ends of the two paddles are connected to the two resistance ropes, respectively. The seat can slide back and forth on the frame. The resistance ropes are tied to the upper ends of the paddles, so as to achieve the function of rowing with two paddles. Furthermore, the ends of the two resistance ropes of the rowing machine are tied together for the user to do rowing exercise, or the ends of the two resistance ropes are connected to respective rings for the user to do chest-expanding exercise. Therefore, the rowing machine not only brings good experience to the user but also has diversified functions.

In the above-mentioned patent, the bottoms of the two paddles are disposed at both sides of the frame and are rotatably connected to the frame, and the upper ends of the two paddles are connected to the two resistance ropes, respectively. When the paddle is pulled, the resistance rope is stretched to drive the rope retractor to rotate. The resistance device is driven to move by the one-way bearing. When the paddle is released, the resistance rope is retracted by the rope retractor. Therefore, the user can pull the two paddles back and forth to do rowing exercise. Since the two resistance ropes are located above the paddles, they cause obstruction and inconvenience when pulling and affect the user's action. This rowing machine can only be operated by using the paddles, without a pull bar, so the scope of use is limited.

As disclosed in Taiwan Patent No. 1750675 on Dec. 21, 2021, a rowing exercise machine that can set with a rowing feeling comprises a movable inertial element; an eddy current brake coupled to the movable inertial element; a rowing grip coupled to the movable inertial element; and a control circuit coupled to the eddy current brake to induce a resistance to movement of the rowing grip during part of a rowing stroke. During the rowing phase of the rowing stroke, the resistance to movement of the rowing grip is consistent with the target perception of the row. The target feeling corresponds to a target feeling of the rower of another rowing exercise machine or another target feeling of concern.

In the above-mentioned patent, the rowing exercise machine is operated by a pull bar only, and cannot be operated by paddles, so the scope of use is limited.

As disclosed in Taiwan Patent No. 1644705 on Dec. 21, 2018, a rowing fitness device includes a base unit, two paddle units and a resistance unit. The base unit includes two bearing seats extending laterally and outwardly, respectively. Each paddle unit includes a guide rod and a paddle. The guide rod is movably disposed on the corresponding bearing seat along its own axis and extends outwardly and downwardly. The paddle has a first connecting portion and a second connecting portion. The first connecting portion is rotatably disposed on the bearing seat. The second connecting portion is pivotally connected to the guide rod. The rotation of the paddle around the first connecting portion drives the guide rod to move along its own axis. The resistance unit provides a resistance to the paddles. Due to the limitation of the movable orientation of the guide rod, the user pulls the paddles in an inclined inward and upward direction, thereby simulating the paddling motion.

In the above-mentioned patent, the paddle unit is driven by multiple connecting rods, so the structure is more complicated and is large in size. Similarly, the rowing exercise machine is operated by paddles only, and cannot be operated by a pull bar. Therefore, it is not ideal for use.

SUMMARY OF THE INVENTION

In order to solve the above-mentioned shortcomings of the conventional rowing exercise machine, the present invention provides a rowing exercise machine, comprising a base frame, a paddle unit, a first rotating shaft, a paddle linkage unit, a resistance unit, a pull bar unit, a second rotating shaft, and a pull bar linkage unit. The base frame includes a slidable seat. The paddle unit is pivotally connected to the base frame. The first rotating shaft is pivotally connected to the base frame in a first axial direction. The paddle linkage unit is disposed on the base frame. The paddle linkage unit includes a paddle linkage member, a paddle one-way driving wheel, and a paddle reel. The paddle linkage member connects the paddle unit and the paddle one-way driving wheel. The paddle one-way driving wheel is pivotally connected to the first rotating shaft. The paddle one-way driving wheel drives the first rotating shaft in a first rotational direction. The paddle one-way driving wheel is idle on the first rotating shaft in a second rotational direction. The paddle reel is connected to the paddle one-way driving wheel. The resistance unit is disposed on the base frame. The resistance unit is connected to the first rotating shaft for providing a rotational resistance to the first rotating shaft. The pull bar unit is disposed on the base frame. The second rotating shaft is pivotally connected to the base frame in the first axial direction. The pull bar linkage unit is disposed on the base frame. The pull bar linkage unit includes a pull bar linkage member, a pull bar transmission wheel, a pull bar one-way wheel, a pull bar reel, and a pull bar driving wheel. The pull bar transmission wheel is connected to the second rotating shaft. The pull bar one-way wheel is pivotally connected to the second rotating shaft. The pull bar one-way wheel drives the second rotating shaft in the first rotational direction. The pull bar one-way wheel is idle on the second rotating shaft in the second rotational direction. The pull bar reel is connected to the second rotating shaft. The pull bar driving wheel is connected to the first rotating shaft. The pull bar unit is connected to the pull bar transmission wheel through the pull bar linkage member. When a first operating force is applied to the paddle unit, the paddle one-way driving wheel and the first rotating shaft are driven to rotate in the first rotational direction, and the paddle reel accumulates a first return force. When the first operating force decreases or disappears, the first return force drives the paddle one-way driving wheel to be idling on the first rotating shaft in the second rotational direction. When a second operating force is applied to the pull bar unit, the pull bar transmission wheel, the pull bar one-way wheel, the second rotating shaft and the pull bar driving wheel are driven to rotate in the first rotational direction together with the first rotating shaft, and the pull bar reel accumulates a second return force. When the second operating force decreases or disappears, the second return force drives the pull bar one-way wheel to be idling on the second rotating shaft in the second rotational direction.

Preferably, the paddle unit includes two paddles and two pivot bases. The two paddles each include a pivot end and a grip end opposite to the pivot end. The two pivot bases each include a swing arm. The swing arm has a swing arm end. The two pivot bases are pivotally connected to the base frame in the first axial direction. The two paddles are pivotally connected to the pivot bases in the second axial direction. The second axial direction is perpendicular to the first axial direction.

Preferably, the paddle linkage unit further includes two first driven wheels. The paddle one-way driving wheel includes two paddle one-way driving wheels. The two first driven wheels are pivotally connected to the base frame in the first axial direction. The two first driven wheels each include a first small wheel and a first large wheel. The paddle linkage member includes two first linkage members and two second linkage members. One end of each first linking member is connected to the corresponding swing arm end, and another end of each first linkage member is wound around the corresponding first small wheel. One end of each second linkage member is wound around the corresponding first large wheel, and another end of each second linkage member is connected to the corresponding paddle one-way driving wheel.

Preferably, the paddle reel includes a first casing, a paddle reel rotating shaft, a first scroll spring, and at least one bolt. The first casing is fixed to the base frame. The paddle reel rotating shaft is rotatably connected to the base frame in the first axial direction. One end of the first scroll spring is fixed to the first casing, and another end of the first scroll spring is fixed to the paddle reel rotating shaft. A connecting disc is provided on the paddle reel rotating shaft. The connecting disc has at least one circular hole. The paddle one-way driving wheel has at least one threaded hole corresponding to the circular hole. The bolt passes through the circular hole and is screwed to the threaded hole. The first casing is covered with a first cover.

Preferably, the pull bar unit is a pull bar. The pull bar linkage member includes two pull bar linkage members. One of the pull bar linkage members has one end connected to the pull bar and another end wound around the pull bar transmission wheel. The other pull bar linkage member is connected to the pull bar one-way wheel and the pull bar driving wheel.

Preferably, the pull bar reel includes a second casing and a second scroll spring. One end of the second scroll spring is fixed to the second casing, and another end of the second scroll spring is fixed to the second rotating shaft.

Preferably, a first one-way bearing is disposed between the paddle one-way driving wheel and the first rotating shaft.

Preferably, a second one-way bearing is disposed between the pull bar one-way wheel and the second rotating shaft.

Preferably, the resistance unit includes a resistance driving wheel, a resistance connecting member, and a resistance member. The resistance driving wheel is connected to the first rotating shaft. The resistance member is connected to the base frame. The resistance connecting member connects the resistance driving wheel and the resistance member.

Preferably, the resistance member is one of a magnetic resistance member, a friction resistance member, an air resistance member, a liquid resistance member, a motor and an electromagnetic brake resistance member.

The above technical features have the following advantages:

1. Through the mutual linkage of the paddle unit and the paddle linkage unit, the rotational resistance can be obtained from the resistance unit. In this way, the two paddles can be pushed back and forth, so that the paddling exercise mode can be selected individually.
2. Through the mutual linkage of the pull bar unit and the pull bar linkage unit, the rotational resistance can be obtained from the resistance unit. In this way, the pull bar unit can be pulled back and forth, so that the pulling exercise mode can be selected individually.
3. The paddle linkage unit and the pull bar linkage unit are connected to the same resistance unit to transmit the rotational resistance, so that different force-applying modes by the paddles and by the pull bar can be implemented on the same base frame. Therefore, the entire rowing exercise machine is small in size to reduce the space occupied and has different operation modes.
4. Each paddle of the paddle unit is individually equipped with the paddle linkage member, the paddle one-way driving wheel and the paddle reel, so any paddle can be operated independently, and the rotational resistance can be obtained through the resistance unit. With the respective transmission structures of the two paddles, the operator can freely choose different exercise modes by using two paddles or a single paddle.

DESCRIPTION OF THE PREFERRED EMBODIMENTS

Embodiments of the present invention will now be described, by way of example only, with reference to the accompanying drawings.

In the following embodiments, the special terms, such as left, right, front, back, up, down etc., refer to the relative orientation recognized by the user F when the user F (referring to FIG. 10 and FIG. 11) sits on the rowing exercise machine provided by the present invention and the upper torso is straight and perpendicular to the ground plane. The spatial terms are only for the convenience of describing the present invention, and do not limit the spatial aspect of the present invention. In addition, the operation of the user F stepping on the front pedals and bending the knees back and forth in a sitting position belongs to a known operation mode, which won't be repeated below.

Figure 1:
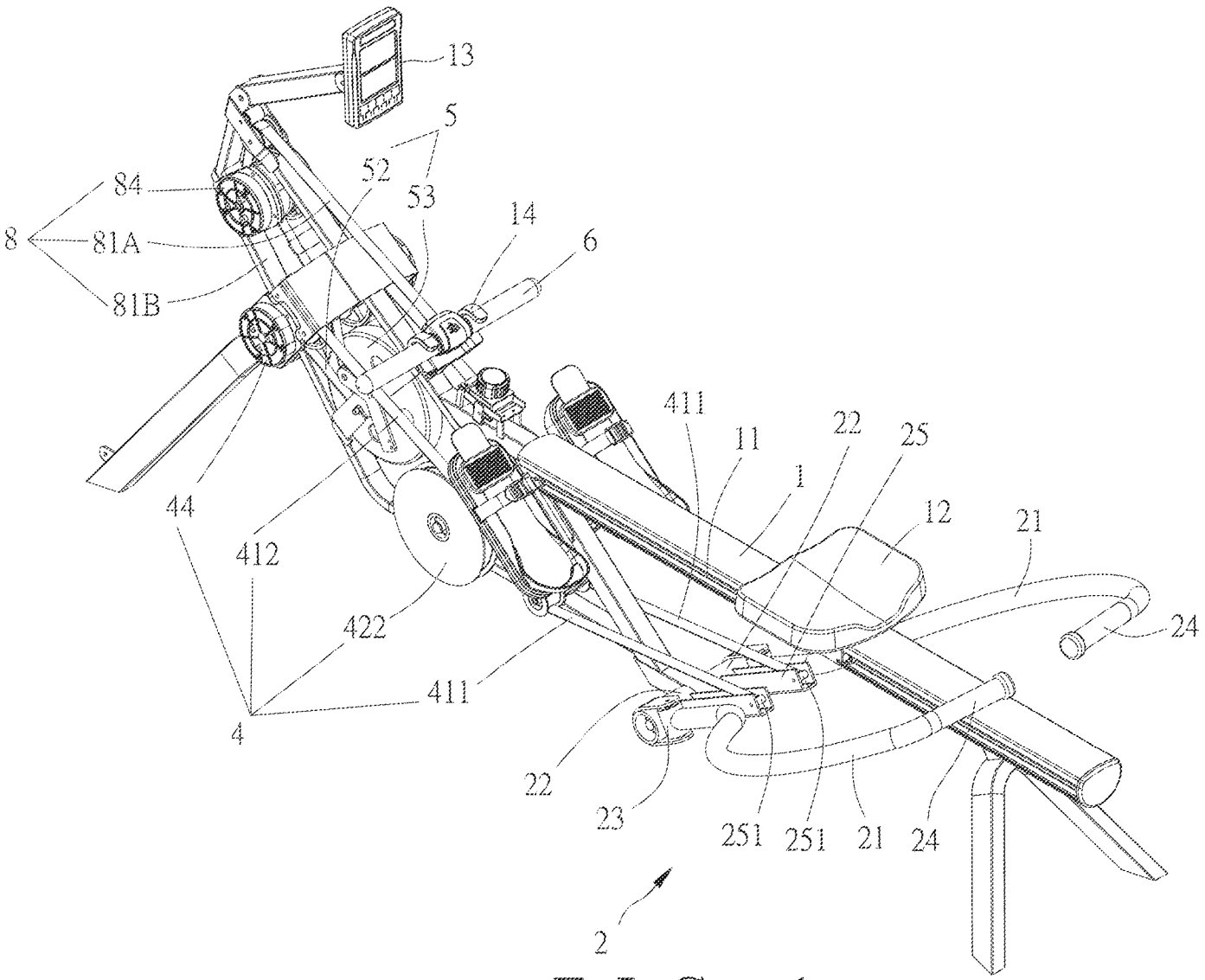
FIG. 1 is a perspective view according to an embodiment of the present.
Figure 2:
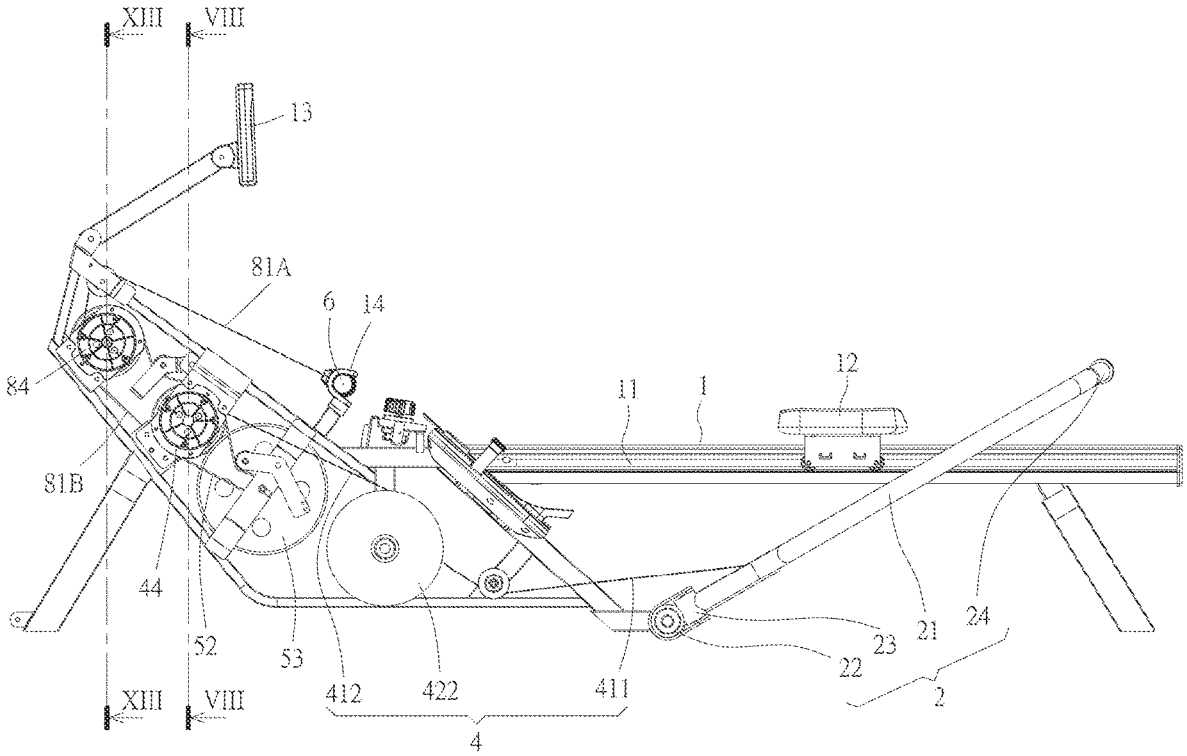
FIG. 2 is a side view according to the embodiment of the present.
Figure 3:
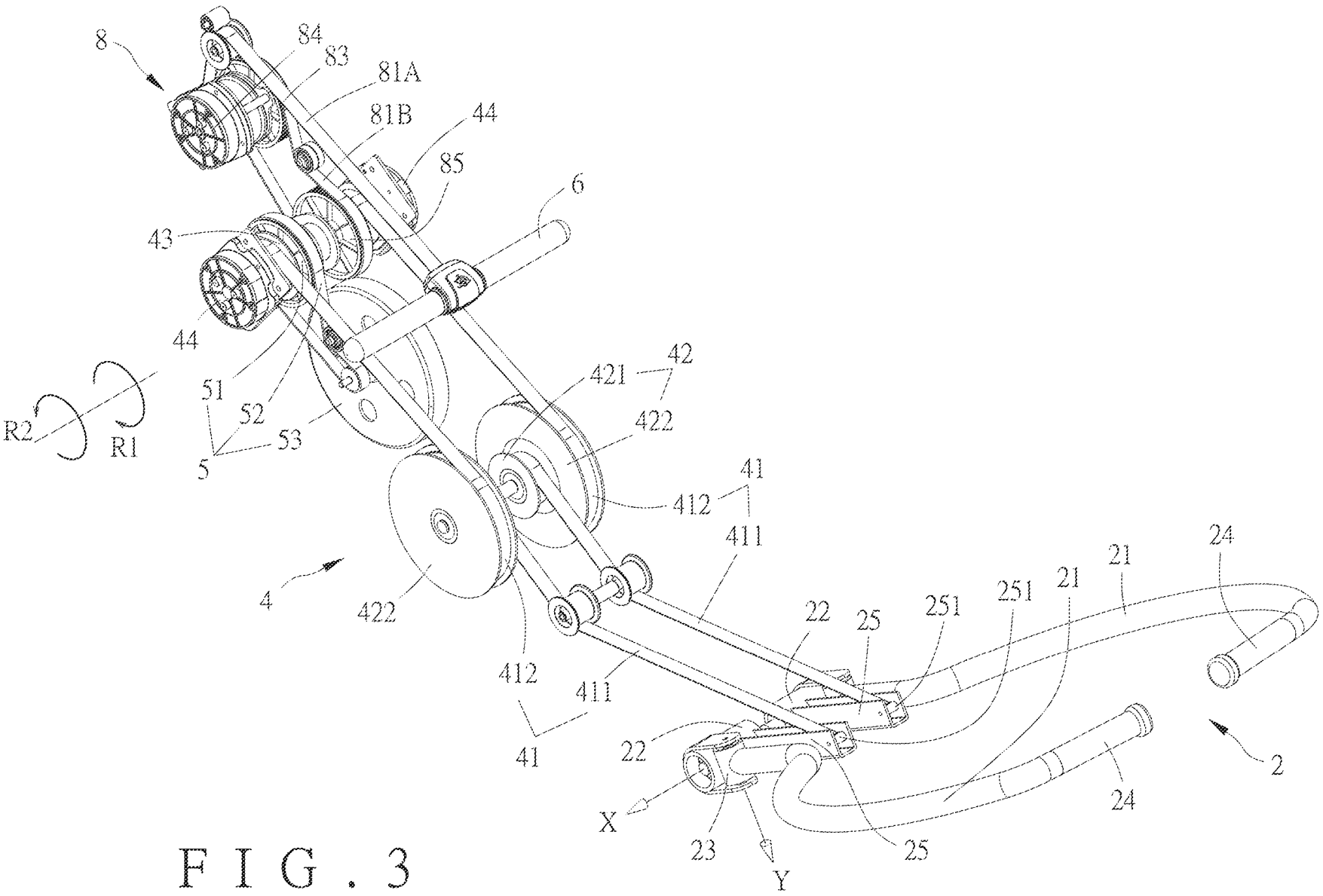
FIG. 3 is a partial perspective view according to the embodiment of the present.

As shown in FIG. 1, FIG. 2 and FIG. 3, an embodiment of the present invention comprises a base frame 1, a paddle unit 2, a first rotating shaft 3 (referring to FIG. 7), a paddle linkage unit 4, a resistance unit 5, a pull bar unit 6, a second rotating shaft 7 (referring to FIG. 13), and a pull bar linkage unit 8. The base frame includes a slide rail 11. The slide rail 11 extends in a front-to-back direction. A seat 12 is slidably connected to the slide rail 11. A display screen 13 and a bracket 14 are provided at the front of the base frame 1.

The paddle unit 2 is pivoted below the base frame 1. The paddle unit 2 includes two paddles 21 and two pivot bases 22 at the left and right sides of the base frame 1. The two paddles 21 each include a pivot end 23 and a grip end 24 opposite to the pivot end 23. The two pivot bases 22 each include a swing arm 25 extending toward the grip end 24. The swing arm 25 has a swing arm end 251. Both the two pivot bases 22 are pivotally connected to the base frame 1 in a first axial direction X. The pivot ends 23 of the two paddles 21 are pivotally connected to the pivot bases 22 in a second axial direction Y. The second axial direction Y is perpendicular to the first axial direction X, so that the two paddles 21 can pivot in the first axial direction X and the second axial direction Y respectively, thereby simulating the action of rowing.

Figure 7:
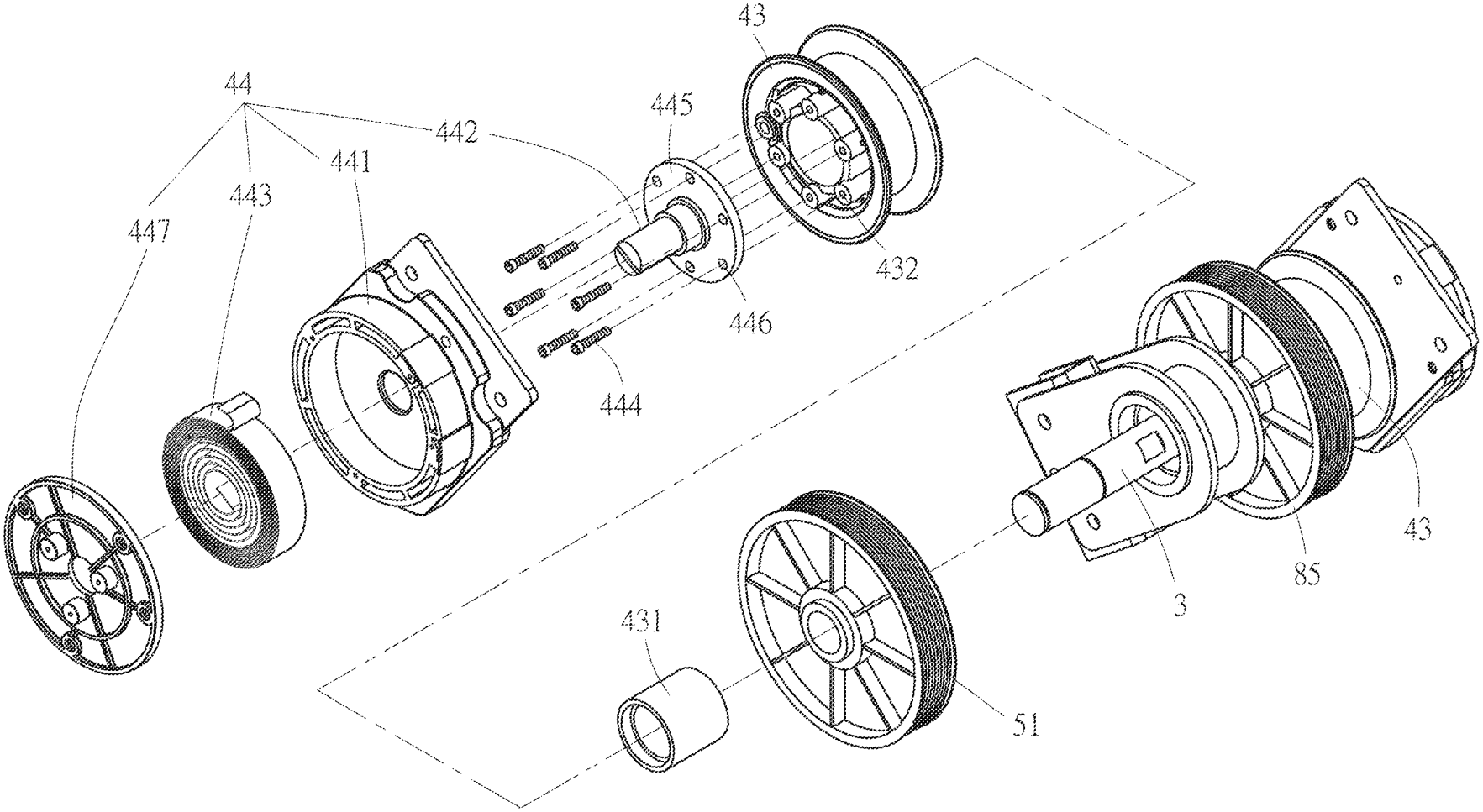
FIG. 7 is a partial exploded view of the paddle linkage unit according to the embodiment of the present.
Figure 8:
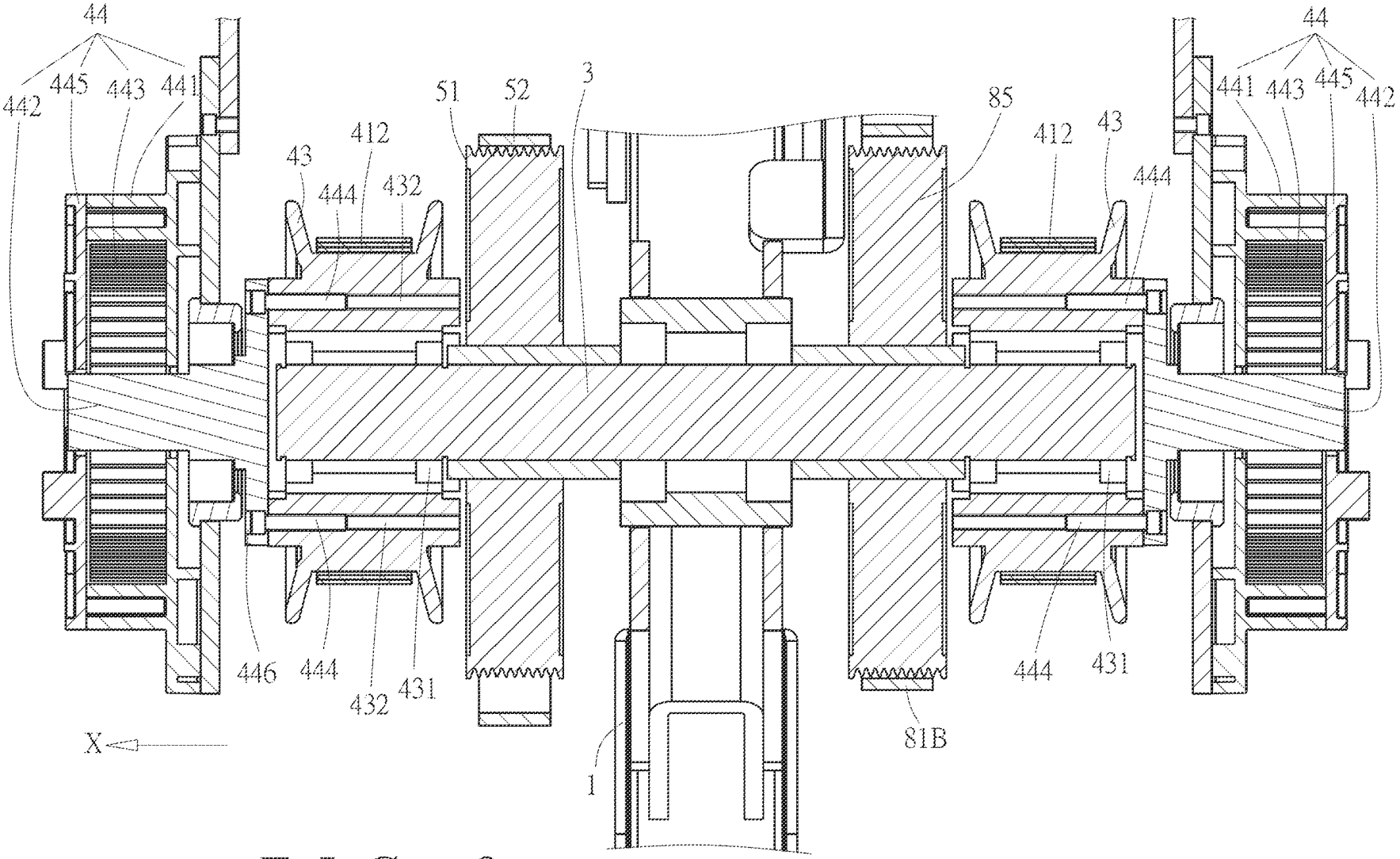
FIG. 8 is a cross-sectional view taken along line VIII-VIII of FIG. 2.

The first rotating shaft 3 (as shown in FIG. 7 and FIG. 8) is pivotally connected to the base frame 1 in the first axial direction X.

Figure 4:
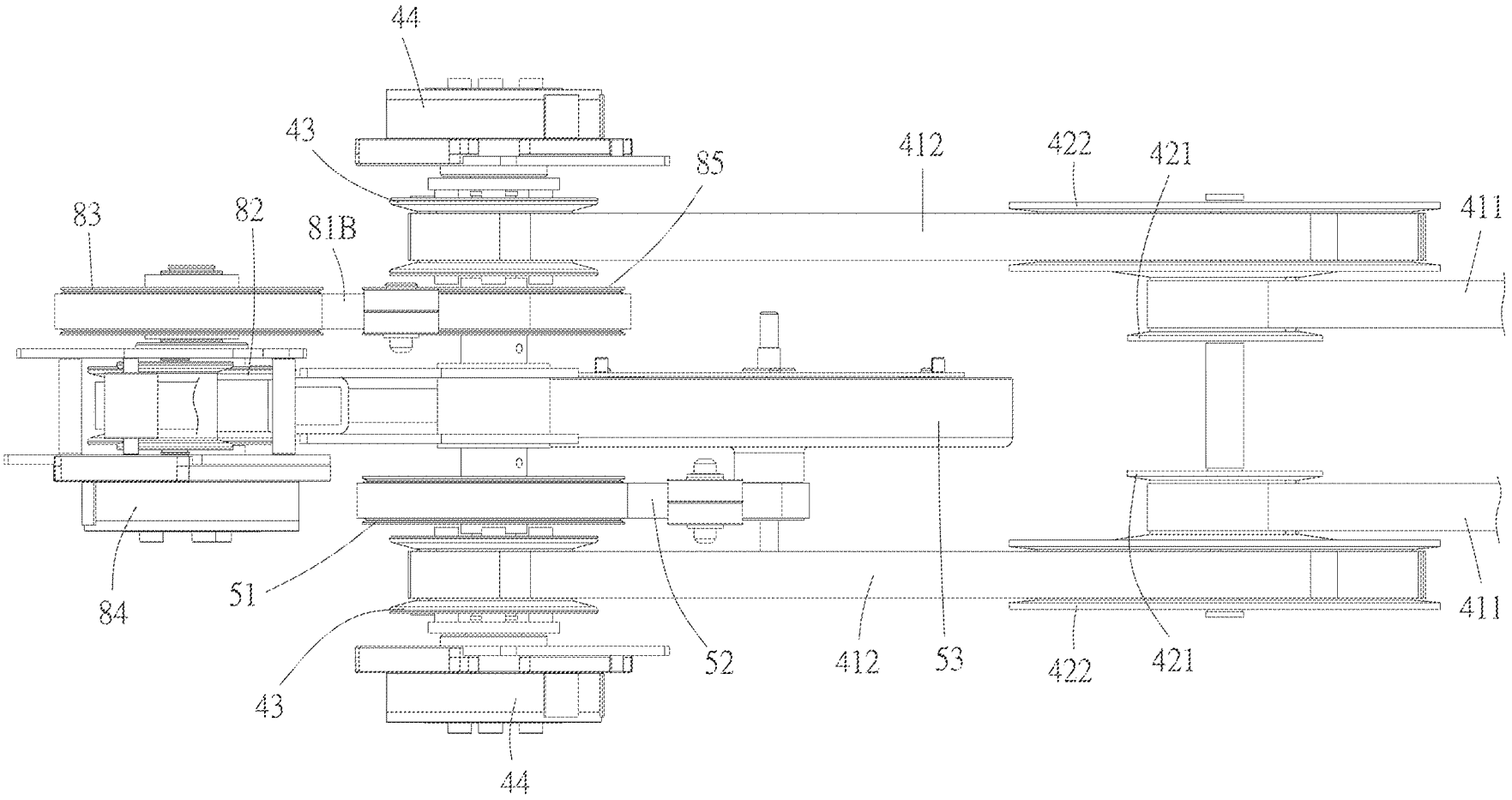
FIG. 4 is a partial top view according to the embodiment of the present.
Figure 5:
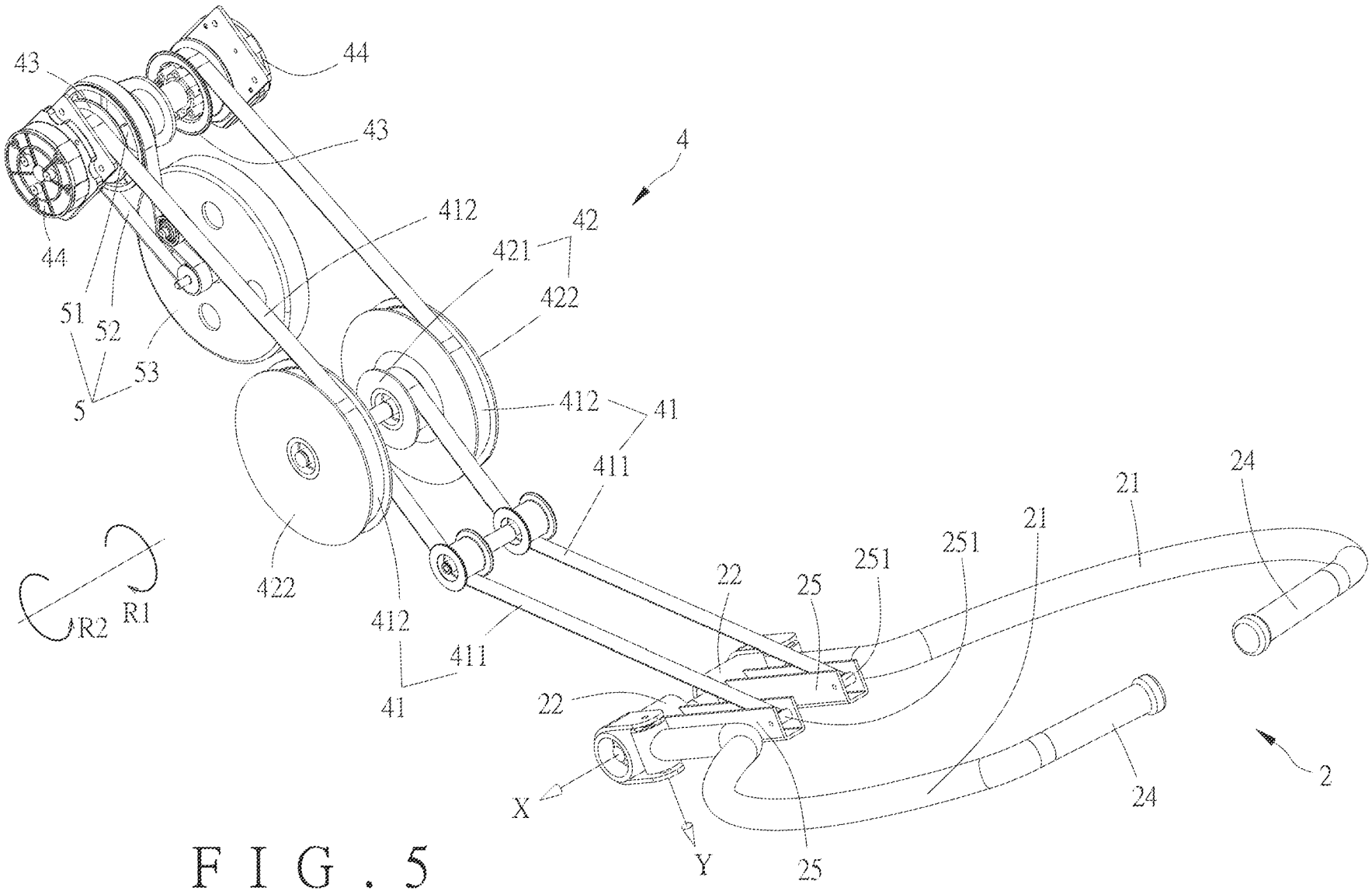
FIG. 5 is a perspective view showing the connection of the paddle unit, the paddle linkage unit and the resistance unit according to the embodiment of the present invention.
Figure 6:
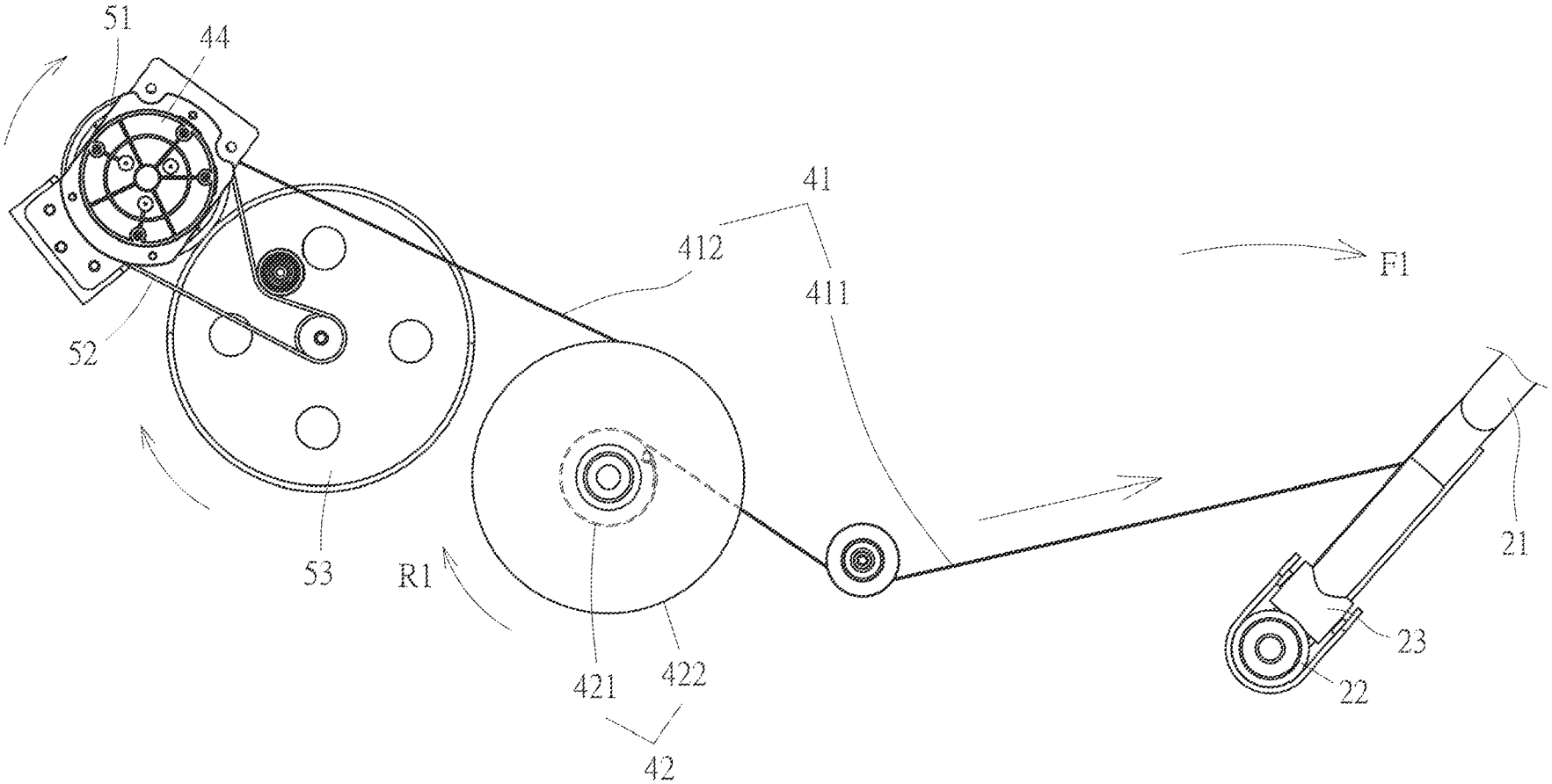
FIG. 6 is a schematic view according to the embodiment of the present invention, wherein the paddle unit is pulled to drive the paddle one-way driving wheel to rotate in the first rotational direction.
Figure 6A:
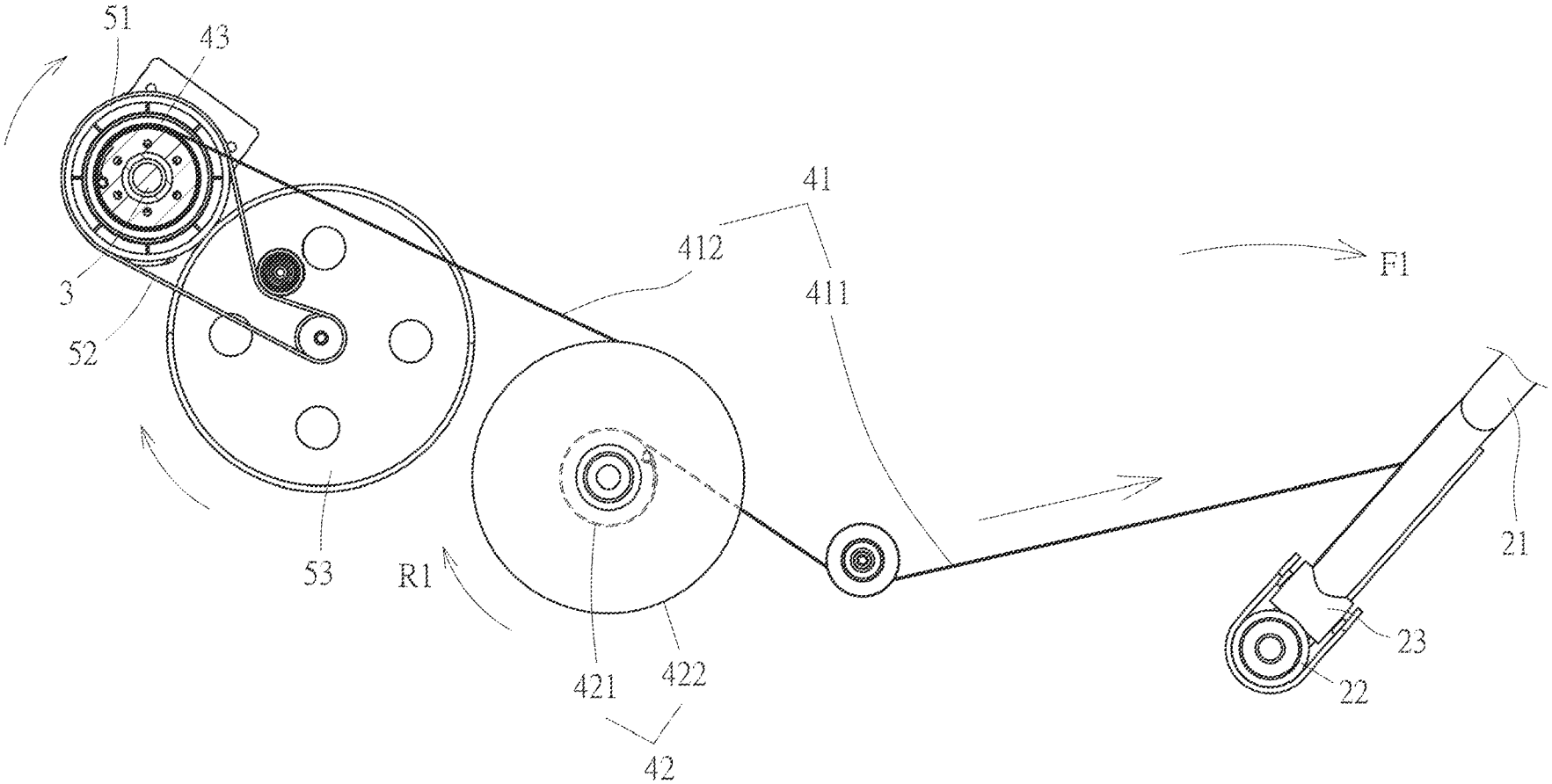
FIG. 6A is a schematic view according to the embodiment of the present invention, wherein the paddle reel is not shown and the paddle unit is pulled to drive the paddle one-way driving wheel to rotate in the first rotational direction.
Figure 9:
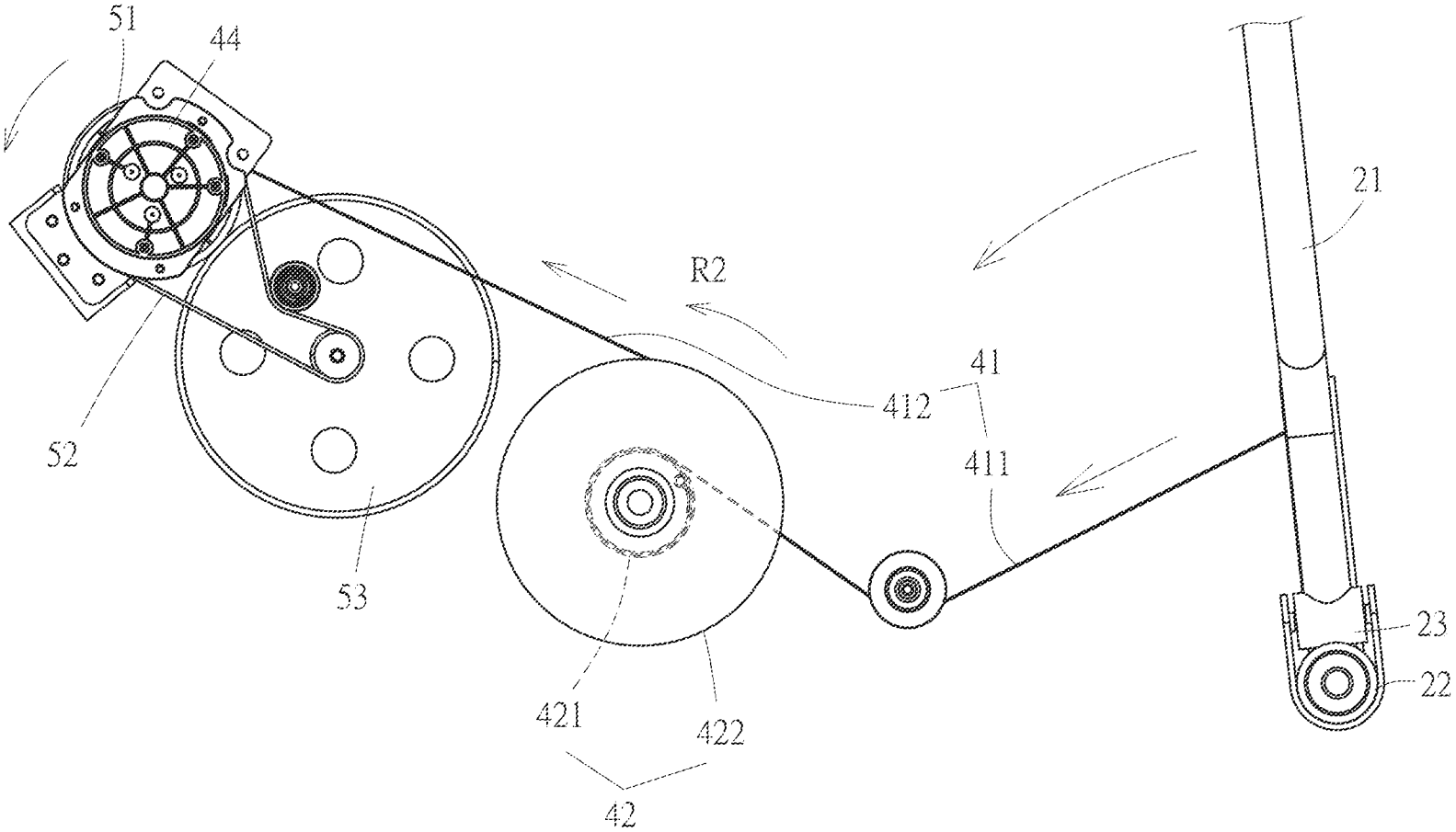
FIG. 9 is a schematic view according to the embodiment of the present invention, wherein the paddle unit is released to drive the paddle one-way driving wheel to rotate in the second rotational direction.

As shown in FIG. 1, FIG. 4 and FIG. 5, the paddle linkage unit 4 is disposed on the base frame 1. The paddle linkage unit 4 includes two paddle linkage members 41, two first driven wheels 42, two paddle one-way driving wheels 43, and two paddle reels 44. The two paddle linkage members 41 connect the paddle unit 2 and the paddle one-way driving wheels 43, respectively. The paddle linkage member 41 includes a first linkage member 411 and a second linkage member 412. The first driven wheel 42 includes a first small wheel 421 and a first large wheel 422. One end of the first linking member 411 is connected to the swing arm end 251, and the other end of the first linkage member 411 is wound around the first small wheel 421. One end of the second linkage member 412 is wound around the first large wheel 422, and the other end of the second linkage member 412 is connected to the paddle one-way driving wheel 43. As shown in FIG. 5, FIG. 7 and FIG. 8, the paddle one-way driving wheel 43 is pivotally connected to the first rotating shaft 3. A first one-way bearing 431 is disposed between the paddle one-way driving wheel 43 and the first rotating shaft 3, so that the paddle one-way driving wheel 43 drives the first rotating shaft 3 in a first rotational direction R1 and the paddle one-way driving wheel 43 is idling on the first rotating shaft 3 in a second rotational direction R2. The paddle reel 44 is connected to the paddle one-way driving wheel 43. The two first driven wheels 42 are pivotally connected to the base frame 1 in the first axial direction X. The paddle reel 44 includes a first casing 441, a paddle reel rotating shaft 442, a first scroll spring 443, and at least one bolt 444. The first casing 441 is fixed to the base frame 1. The paddle reel rotating shaft 442 is rotatably connected to the base frame 1 in the first axial direction X. One end of the first scroll spring 443 is fixed to the first casing 441, and the other end of the first scroll spring 443 is fixed to the paddle reel rotating shaft 442. A connecting disc 445 is provided on the paddle reel rotating shaft 442. The connecting disc 445 has at least one circular hole 446. The paddle one-way driving wheel 43 has at least one threaded hole 432 corresponding to the circular hole 446. The bolt 444 passes through the circular hole 446 and is screwed to the threaded hole 432, so that the paddle reel rotating shaft 442 and the paddle one-way driving wheel 43 are connected. Then, the first casing 441 is covered with a first cover 447. As shown in FIG. 6 and FIG. 6A, the user grips the grip ends 24 of the two paddles 21 to apply a force rearward. A first operating force F1 is applied to pull the two paddle linkage members 41. The paddle linkage member 41 and the two first driven wheels 42 drive the paddle one-way driving wheel 43 to rotate the first rotating shaft 3 in the first rotational direction R1. As shown in FIG. 1. FIG. 7 and FIG. 8, when the first rotating shaft 3 rotates in the first rotational direction R1, the paddle one-way driving wheel 43 and the paddle reel rotating shaft 442 will rotate in the first rotational direction R1 synchronously because the one-way driving wheel 43 is connected to the paddle reel rotating shaft 442. The rotation of the paddle reel rotating shaft 442 will tighten the first scroll spring 443 so that the first scroll spring 443 accumulates a first return force. When the first operating force F1 applied to the two paddle linkage members 41 decreases or disappears (as shown in FIG. 9), the first scroll spring 443 drives the paddle reel rotating shaft 112 and the paddle one-way driving wheel 43 to rotate in the second rotational direction R2 synchronously via the first return force. Because the first one-way bearing 431 is provided between the paddle one-way driving wheel 43 and the first rotating shaft 3, the paddle one-way driving wheel 43 is idling on the first rotating shaft 3 in the second rotational direction R2.

When the paddle one-way driving wheel 43 is idling in the second rotational direction R2, it will drive the first driven wheel 42 to rotate in the second rotational direction R2 so as to wind up the two paddle linkage members 41.

Please refer to FIG. 1, FIG. 3 and FIG. 4. The resistance unit 5 is disposed on the base frame 1. The resistance unit 5 is indirectly connected to the first rotating shaft 3 for providing a rotational resistance to the first rotating shaft 3. The resistance unit 5 includes a resistance driving wheel 51, a resistance connecting member 52, and a resistance member 53. The resistance driving wheel 51 is connected to the first rotating shaft 3. The resistance member 53 is connected to the base frame 1. The resistance connecting member 52 connects the resistance driving wheel 51 and the resistance member 53. The resistance member 53 is configured to generate the rotational resistance. The resistance member 53 of the present invention may be one of a magnetic resistance member, a friction resistance member, an air resistance member, a liquid resistance member, a motor and an electromagnetic brake resistance member.

Please refer to FIG. 1. The pull bar unit 6 is disposed on the base frame 1. The pull bar unit 6 is a pull bar, which can be received in the bracket 14.

Figure 13:
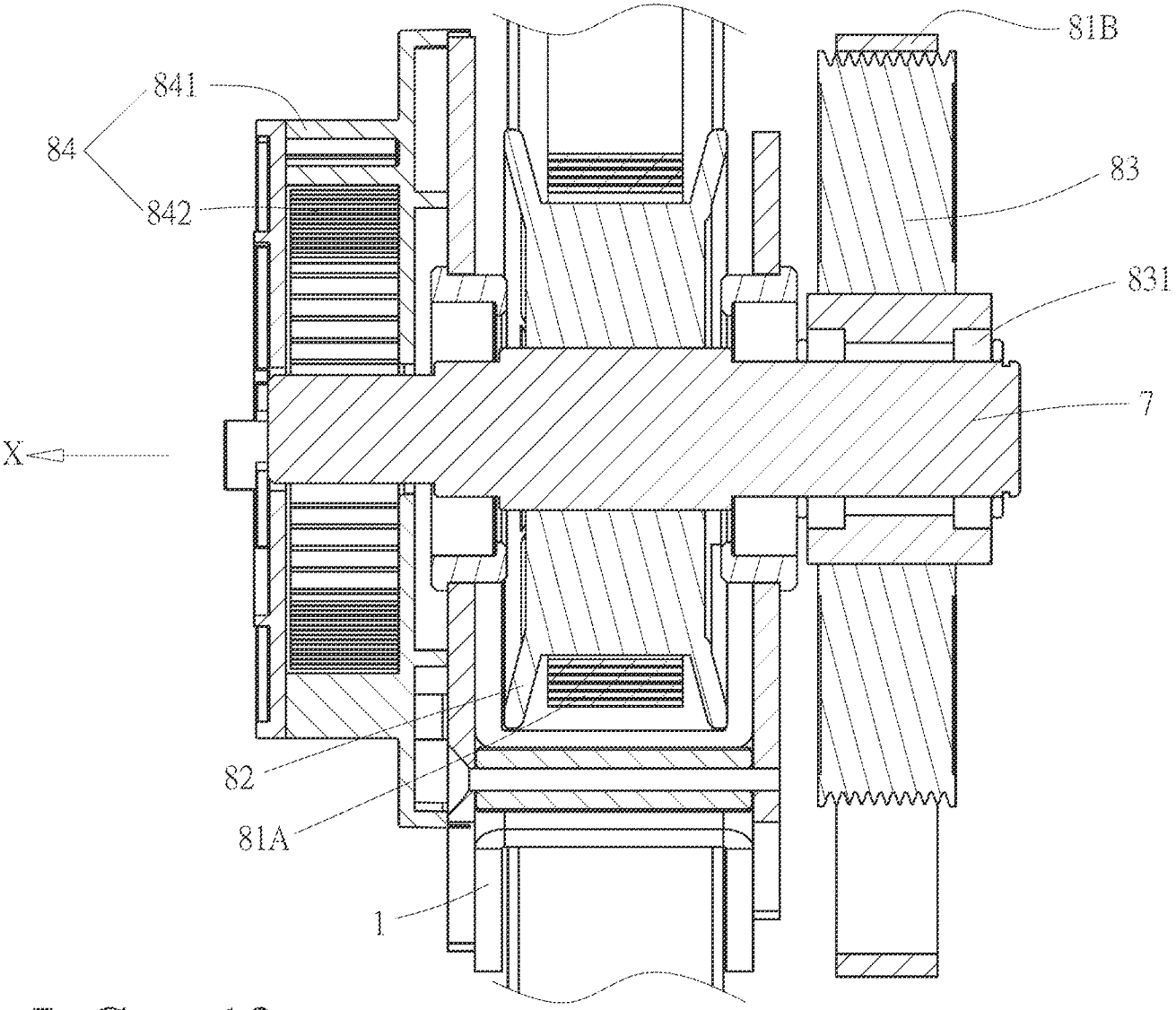
FIG. 13 is a cross-sectional view taken along line XIII-XIII of FIG. 2.
Figure 14:
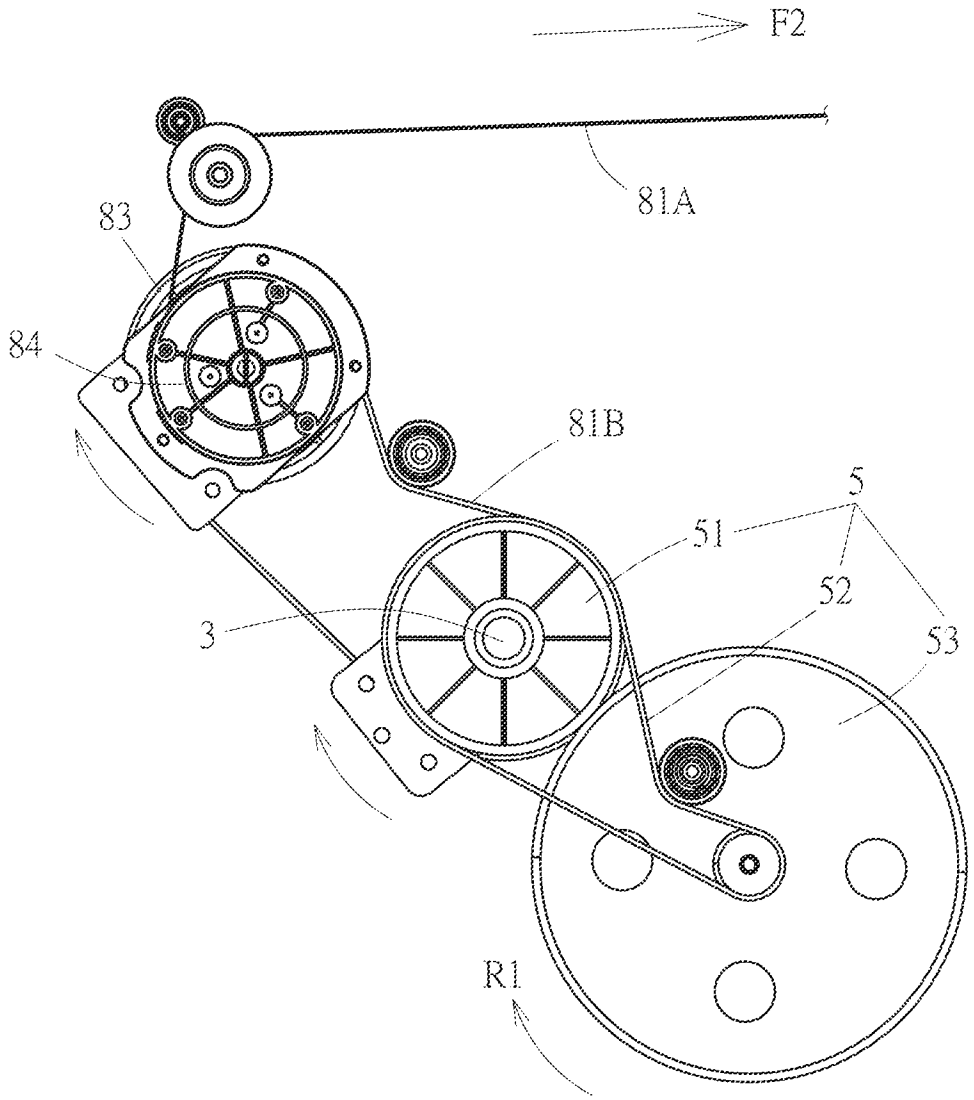
FIG. 14 is a schematic view according to the embodiment of the present invention, wherein the pull bar unit is pulled to drive the pull bar transmission wheel to rotate in the first rotational direction.

Please refer to FIG. 1, FIG. 13 and FIG. 14. The second rotating shaft 7 is pivotally connected to the base frame 1 in the first axial direction X.

Figure 12:
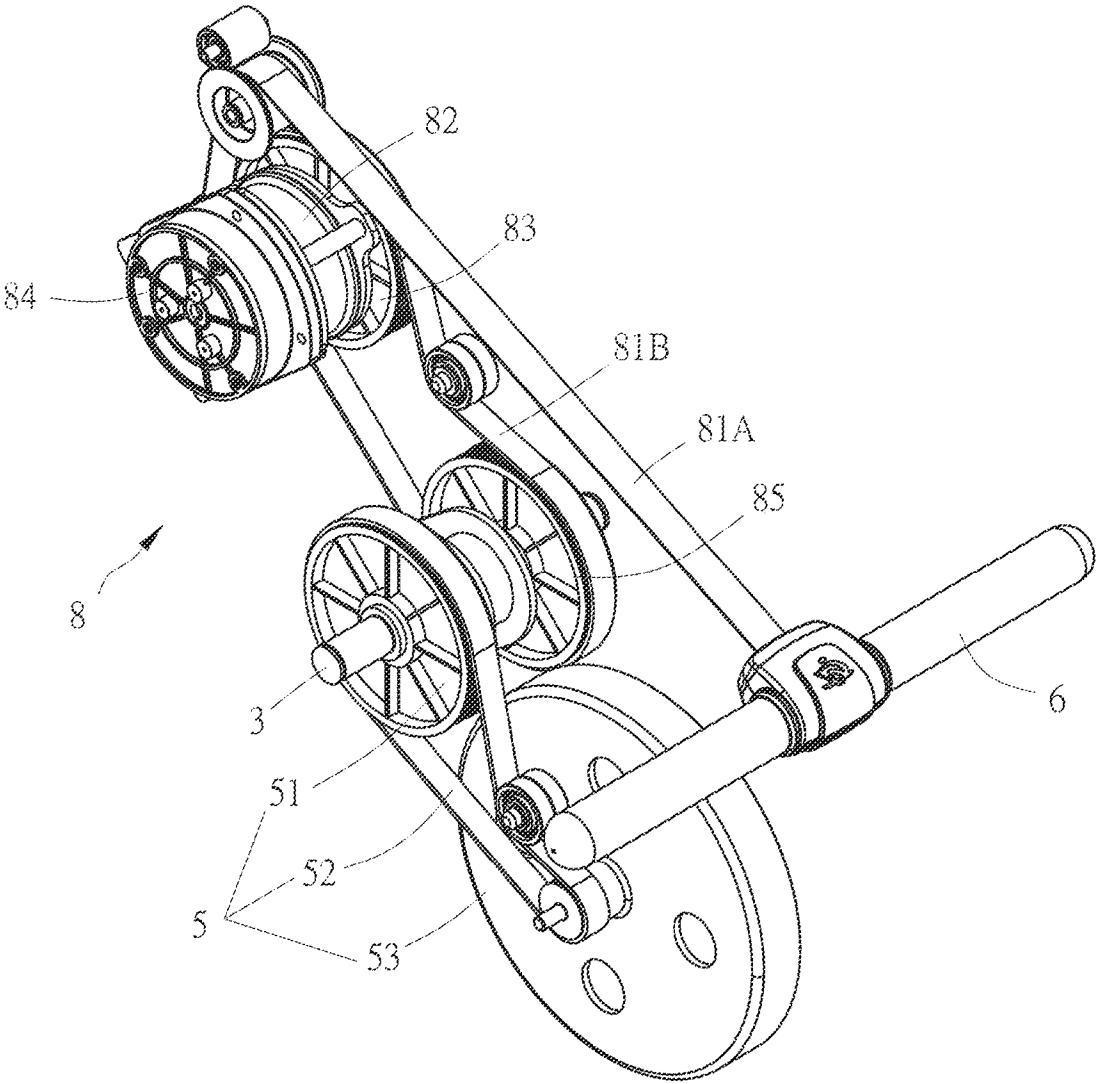
FIG. 12 is a schematic view showing the connection of the resistance unit, the pull bar unit and the pull bar linkage unit according to the embodiment of the present invention.
Figure 14A:
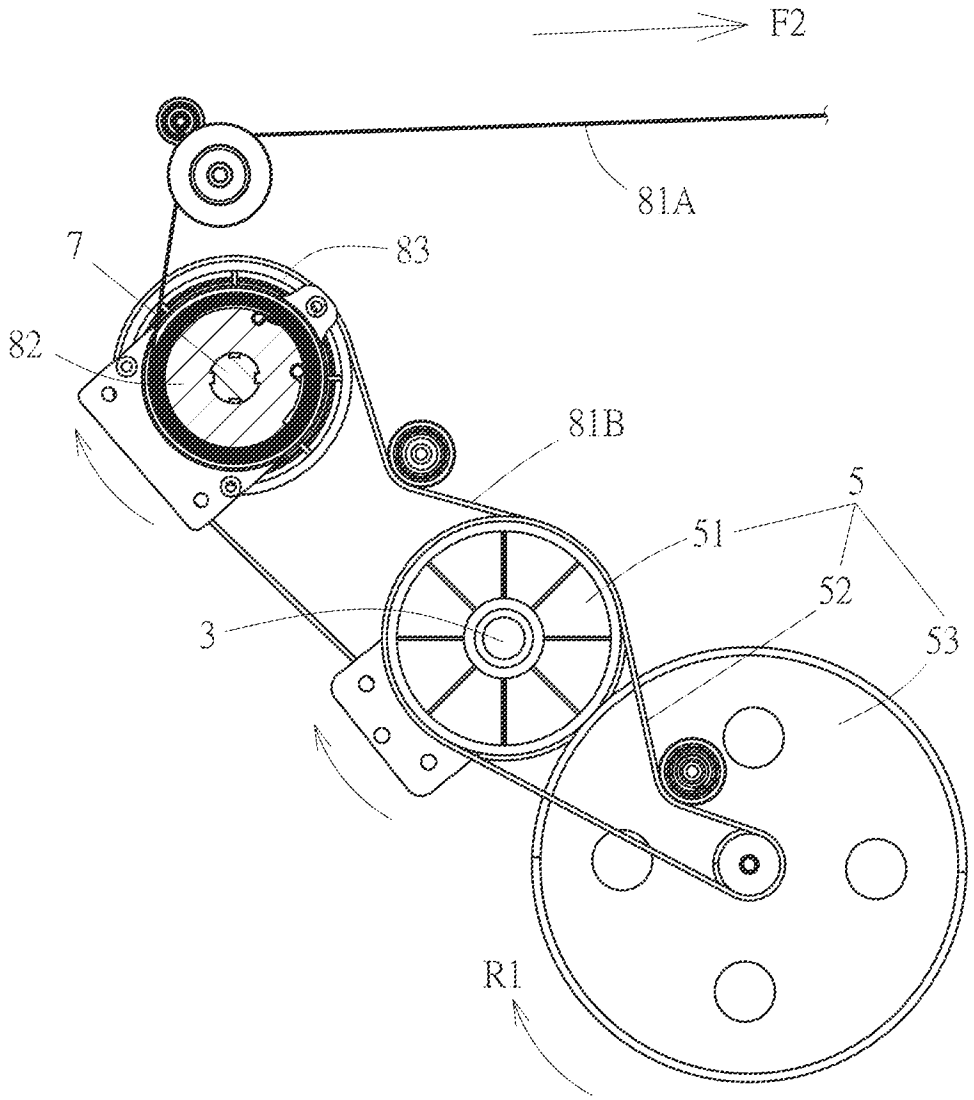
FIG. 14A is a schematic view according to the embodiment of the present invention, wherein the pull bar reel is not shown and the pull bar transmission wheel is driven to rotate in the first rotational direction.

Please refer to FIG. 1, FIG. 12 and FIG. 13. For the convenience of explaining the pull bar linkage unit 8, the two paddle one-way driving wheels 43 on the first rotating shaft 3 are not shown in FIG. 2. The pull bar linkage unit 8 is disposed on the base frame 1. The pull bar linkage unit 8 includes two pull bar linkage members 81A, 81B, a pull bar transmission wheel 82, a pull bar one-way wheel 83, a pull bar reel 84, and a pull bar driving wheel 85. The pull bar transmission wheel 82 is connected to the second rotating shaft 7. The pull bar one-way wheel 83 is pivotally connected to the second rotating shaft 7. A second one-way bearing 831 is disposed between the pull bar one-way wheel 83 and the second rotating shaft 7, so that the pull bar one-way wheel 83 drives the second rotating shaft 7 in the first rotational direction R1 and the pull bar one-way wheel 83 is idling on the second rotating shaft 7 in the second rotational direction R2. The pull bar reel 84 is connected to the second rotating shaft 7. The pull bar driving wheel 85 is connected to the first rotating shaft 3. The pull bar unit 6 is connected to the pull bar transmission wheel 82 through the pull bar linkage member 81A. One end of the pull bar linkage member 81A is connected to the pull bar unit 6, and the other end of the pull bar linkage member 81A is wound around the pull bar transmission wheel 82. The other pull bar linkage member 81B is connected to the pull bar one-way wheel 83 and the pull bar driving wheel 85. The pull bar reel 84 includes a second casing 841 and a second scroll spring 842. One end of the second scroll spring 842 is fixed to the second casing 41, and the other end of the second scroll spring 842 is fixed to the second rotating shaft 7. When the user grips the pull bar unit 6 to apply a force rearward, a second operating force F2 is applied to pull the pull bar linkage member 81A, as shown in FIG. 14 and FIG. 14A, so as to drive the pull bar transmission wheel 82 to rotate the second rotating shaft 7 in the first rotational direction R1. When the second rotating shaft 7 rotates in the first rotational direction R1, the pull bar one-way wheel 83 is driven to rotate in the first rotational direction R1 by the second one-way bearing 831, and the second scroll spring 842 is rolled, so that the second scroll spring 842 accumulates a second return force. Please refer to FIG. 12, FIG. 13 and FIG. 15. When the second operating force F2 decreases or disappears, the second scroll spring 842 reversely drives the second rotating shaft 7 to rotate in the second rotational direction R2 via the second return force. At this time, the second rotating shaft 7 and the pull bar transmission wheel 82 rotate in the second rotational direction R2 synchronously, and the pull bar linkage members 81A, 81B are wound up by the pull bar transmission wheel 82. Because the second one-way bearing 831 is provided between the second rotating shaft 7 and the pull bar one-way wheel 83, when the second rotating shaft 7 rotates in the second rotational direction R2, the pull bar one-way wheel 83 will not rotate in the second rotational direction R2 along with the second rotating shaft 7.

Figure 10:
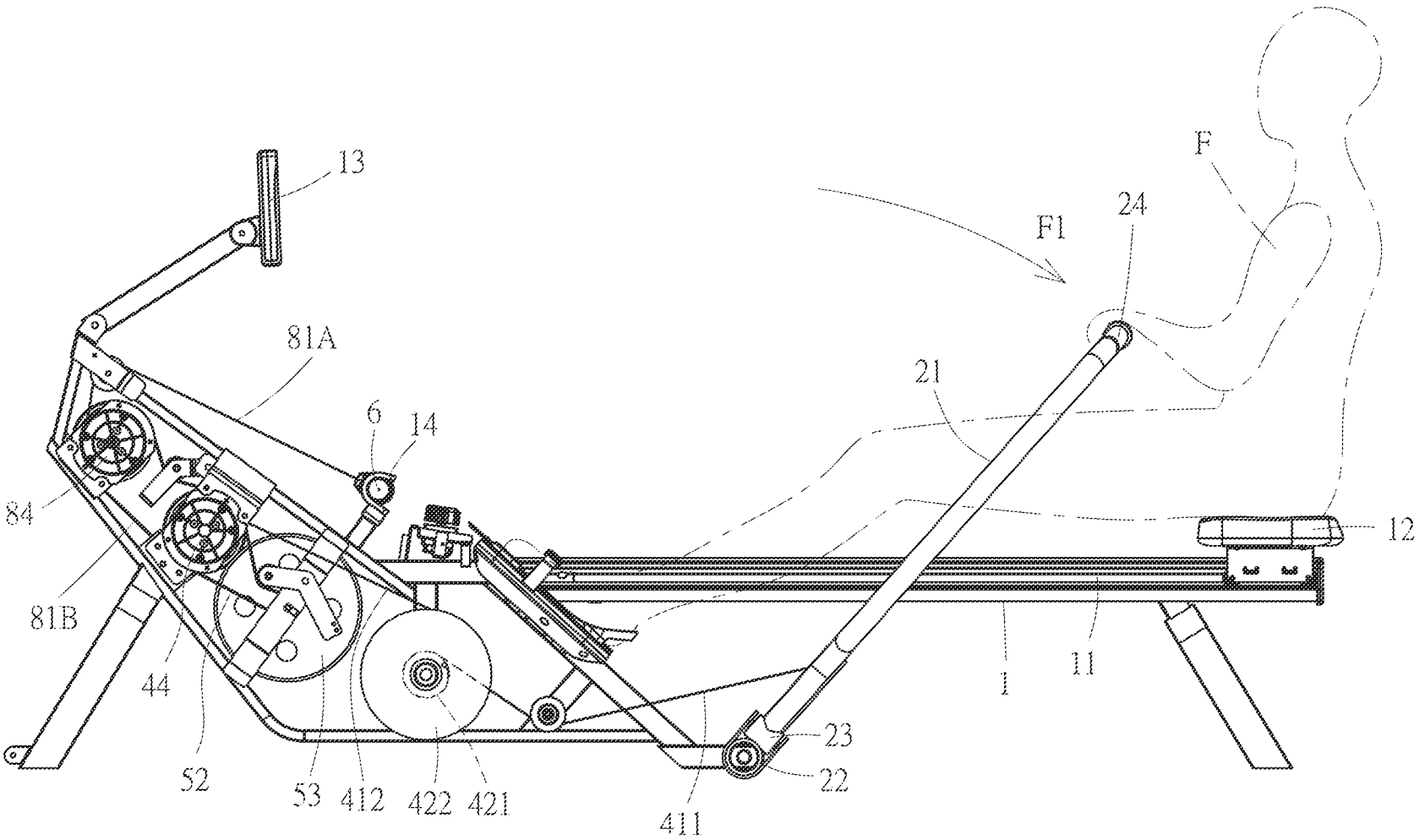
FIG. 10 is a schematic view of pulling the paddle unit according to the embodiment of the present invention.

When the paddles are used to apply force, as shown in FIG. 3, FIG. 4 and FIG. 10, the user F can sit on the seat 12 and hold the grip ends 24 of the two paddles 21 with both hands respectively. Then, the two paddles 21 are pulled backward and outward toward the rear end of the base frame 1 by the user's both hands, so that the two paddles 21 are pivoted in the first axial direction X and the second axial direction Y respectively, so as to simulate rowing actions. When the paddle 21 is pulled backward (as shown in FIG. 6 and FIG. 6A), the first linkage member 411 of the paddle linkage member 41 is pulled by the swing arm end 251. The first linkage member 411 drives the first small wheel 421 and the first large wheel 422 of the first driven wheel 42 to rotate in the first rotational direction R1. The first large wheel 422 drives the first rotating shaft 3 to rotate in the first rotational direction R1 through the second linkage member 412 to drive the paddle one-way driving wheel 43 (as shown in FIG. 7 and FIG. 8). At this time, the paddle one-way driving wheel 43 drives the paddle reel rotating shaft 442 to rotate in the first rotational direction R1 synchronously, so that the first scroll spring 443 accumulates a first return force. At this time, the first rotating shaft 3 drives the resistance driving wheel 51 to rotate in the first rotational direction R1 synchronously. The resistance driving wheel 51 drives the resistance member 53 to rotate through the resistance connecting member 52, so that the first rotating shaft 3 has a rotational resistance. The rotational resistance can be transmitted to the paddle 21 through the paddle linkage unit 4, so as to simulate the resistance of water during rowing.

Figure 11:
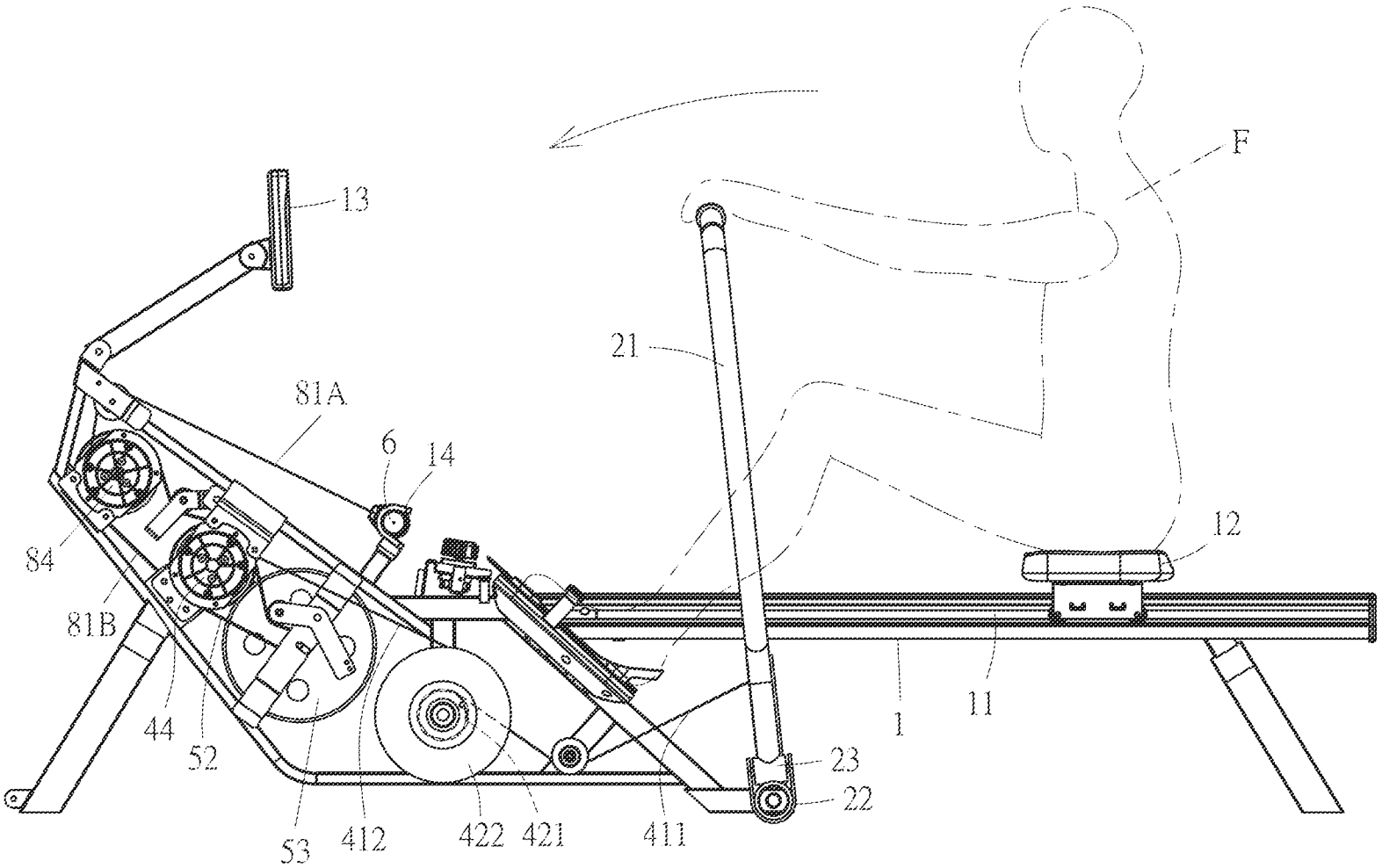
FIG. 11 is a schematic view of releasing the paddle unit according to the embodiment of the present invention.

As shown in FIG. 3, FIG. 4 and FIG. 11, when the two paddles 21 are no longer pulled or the applied force is reduced, the first operating force F1 will disappear or be reduced. At this time, the first scroll spring 443 of the paddle reel 44 drives the paddle reel rotating shaft 442 to rotate in the second rotational direction R2 via the first return force (as shown in FIG. 7 and FIG. 8). The paddle reel rotating shaft 442 synchronously drives the paddle one-way driving wheel 43 to be idling on the first rotating shaft 3 in the second rotational direction R2. By the idling of the paddle one-way driving wheel 43 in the second rotational direction R2, the first large wheel 422 and the first small wheel 421 are driven to rotate in the second rotational direction R2. Thereby, the first linkage members 411 and the second linkage members 412 of the two paddle linkage members 41 are retracted, and the two paddles 21 are returned to their original positions. When the paddle one-way driving wheel 43 is idling on the first rotating shaft 3 in the second rotational direction R2, the first rotating shaft 3 is stationary. Therefore, at this time, the resistance unit 5 will not generate any resistance to the rotation of the paddle one-way driving wheel 43 in the second rotational direction R2. If only the left paddle 21 is pulled backward, the left paddle one-way driving wheel 43 will drive the first rotating shaft 3 to rotate in the first rotational direction R1, thereby obtaining the resistance of the resistance unit 5. At this time, if the right paddle 21 is not moved, the rotation of the first rotating shaft 3 in the first rotational direction R1 will not cause the right paddle one-way driving wheel 43 to rotate together, but the right paddle one-way driving wheel 43 is idling on the first rotating shaft 3. Similarly, if only the right paddle 21 is pulled backward, the left paddle one-way driving wheel 43 will be idling on the first rotating shaft 3. The two paddle reels 44 are located at the left side and the right side, respectively. The two paddle reels 44 can drive their respective paddle reel rotating shafts 442, and then the left paddle one-way driving wheel 43 and the right paddle one-way driving wheel 43 are driven to be idling on the respective first rotating shafts 3 in the second rotational direction R2. Therefore, the two paddles 21 can be operated independently, that is, the single-paddle operation or the double-paddle operation can be freely selected in practice.

When the pull bar is used to apply force, as shown in FIG. 4, FIG. 8, FIG. 12 and FIG. 16, the user F can sit on the seat 12 and hold the pull bar unit 6 with both hands. Then, the user's both hands apply a second operating force F2 toward the rear end of the base frame 1 to pull the pull bar unit 6. The pull bar unit 6 drives the pull bar transmission wheel 82 and the second rotating shaft 7 to rotate synchronously in the first rotational direction R1 through the pull bar linkage member 81A (as shown in FIG. 14 and FIG. 14A). The second rotating shaft 7 drives the pull bar one-way wheel 83 to rotate in the first rotational direction R1 through the second one-way bearing 831. When the second rotating shaft 7 rotates, the second scroll spring 842 is rotated at the same time, so that the second scroll spring 842 accumulates a second return force (as shown in FIG. 13). At this time, the pull bar one-way wheel 83 drives the pull bar driving wheel 85 located on the first rotating shaft 3 through the pull bar linkage member 81B. The pull bar driving wheel 85 drives the resistance driving wheel 51 to rotate in the first rotational direction R1 through the first rotating shaft 3. The resistance driving wheel 51 drives the resistance member 53 to rotate through the resistance connecting member 52, so that the first rotating shaft 3 has a rotational resistance. The rotational resistance can be transmitted to the pull bar unit 6 through the pull bar linkage unit 8, so as to simulate the resistance of water during rowing.

Figure 15:
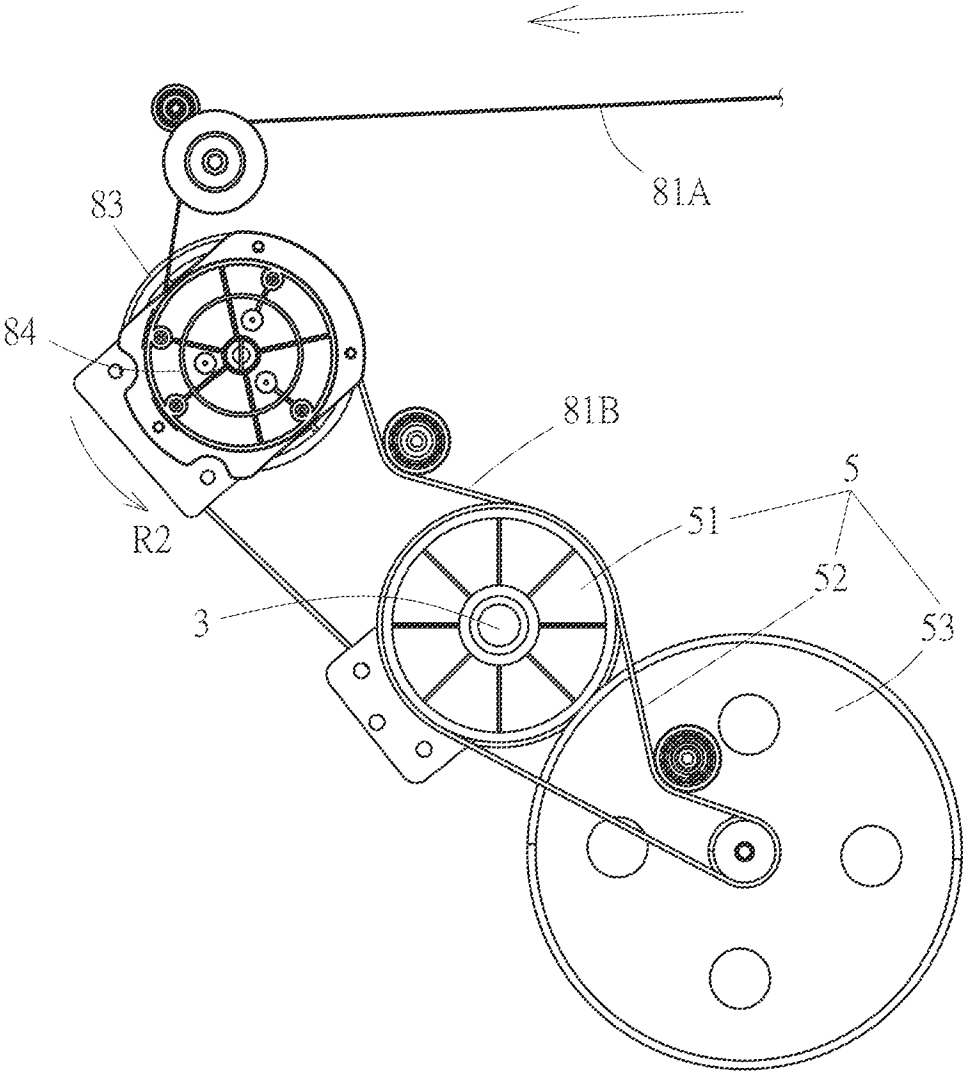
FIG. 15 is a schematic view according to the embodiment of the present invention, wherein the pull bar unit is released to drive the pull bar transmission wheel to rotate in the second rotational direction.
Figure 16:
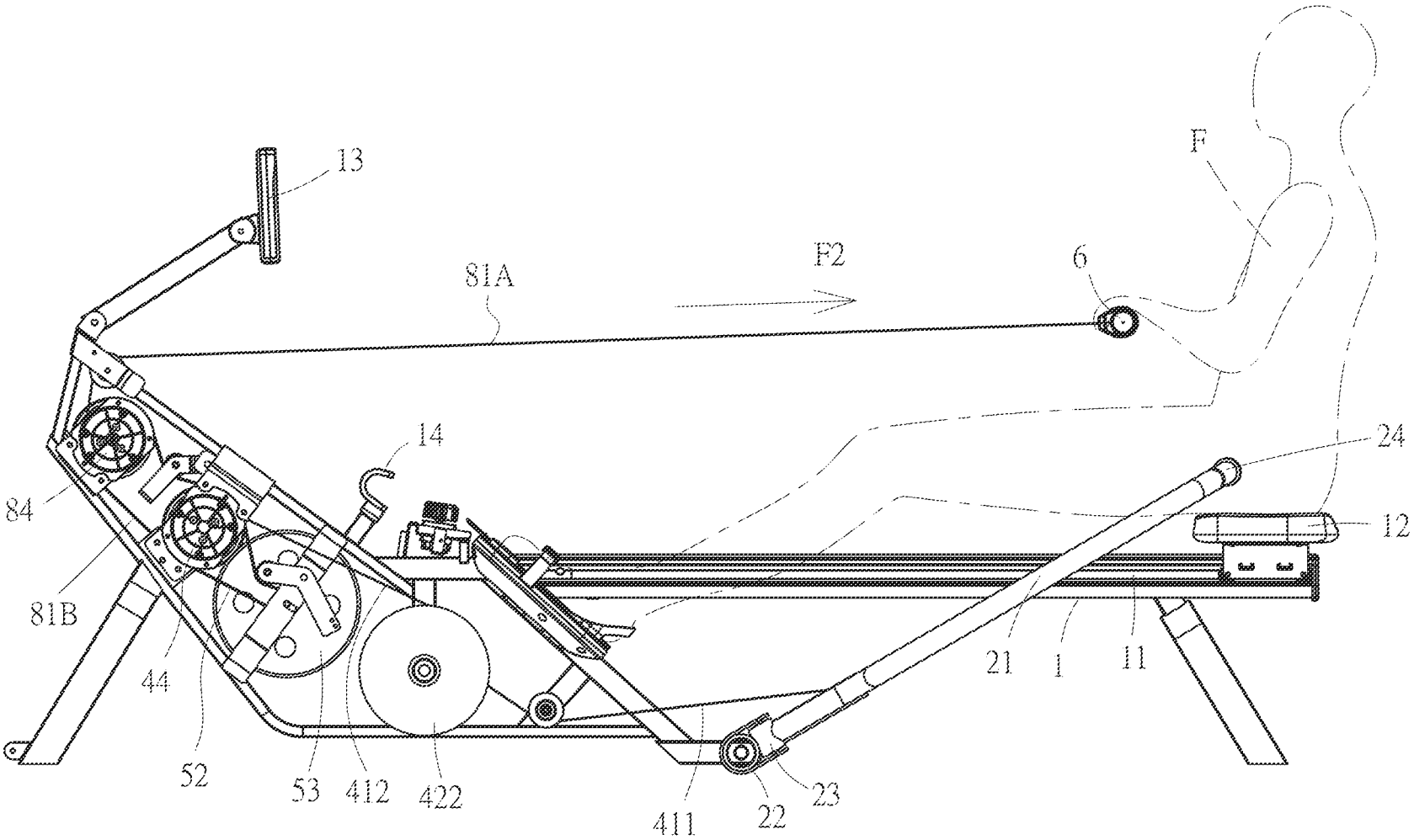
FIG. 16 is a schematic view of pulling the pull bar unit according to the embodiment of the present invention.
Figure 17:
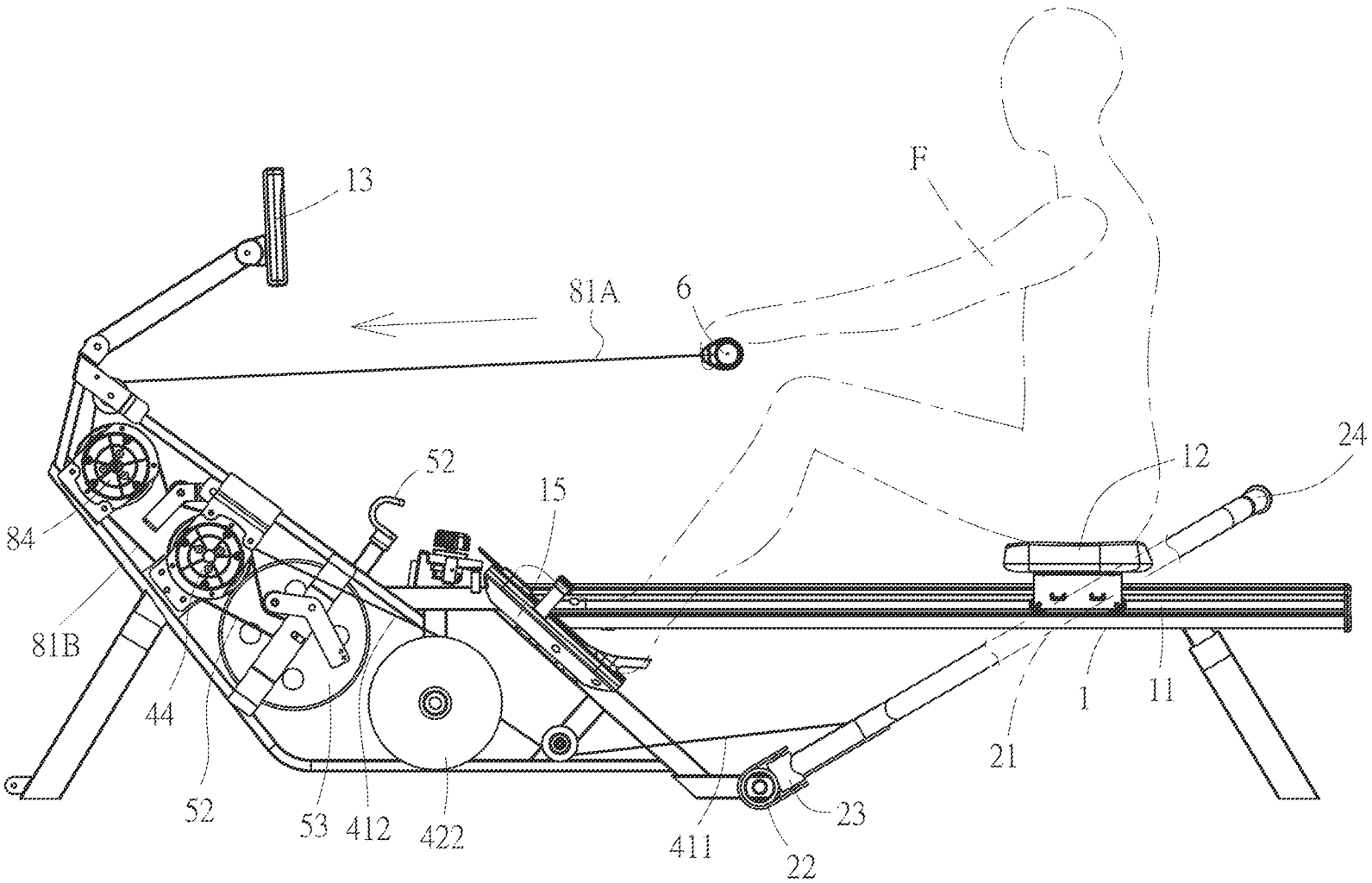
FIG. 17 is a schematic view of releasing the pull bar unit according to the embodiment of the present invention.

As shown in FIG. 13, FIG. 15 and FIG. 17, when the pull bar unit 6 is no longer pulled, the second operating force F2 will disappear or be reduced. The second scroll spring 842 drives the second rotating shaft 7 and the pull bar transmission wheel 82 to rotate synchronously in the second rotational direction R2 via the second return force (as shown in FIG. 12). Thereby, the pull bar transmission wheel 82 winds up the two pull bar linkage members 81A, 81B, and the pull bar unit 6 is returned to its original position. When the second rotating shaft 7 rotates in the second rotational direction R2, the pull bar one-way wheel 83 will not rotate along with the second rotating shaft 7 in the second rotational direction R2, so the resistance unit 5 will not generate resistance to the second rotating shaft 7. By pulling the pull bar unit 6 reciprocally, the pulling exercise mode can be achieved.

The embodiment of the present invention utilizes the mutual linkage of the paddle unit 2 and the paddle linkage unit 4 to obtain the rotational resistance, and the user F can pull the two paddles 21 reciprocally to obtain a paddling exercise mode. In particular, the paddle 21 on the left side and the paddle 21 on the right side can be operated independently or at the same time, and the operations can be varied. Through the mutual linkage of the pull bar unit 6 and the pull bar linkage unit 8, the user can pull the pull bar unit 6 reciprocally to obtain a pulling exercise mode. The paddle linkage unit 4 and the pull bar linkage unit 8 can be connected to the same resistance unit 5 to transmit the rotational resistance, so that different force-applying modes by the paddles and by the pull bar can be implemented on the same base frame 1. Therefore, the entire rowing exercise machine is small in size to reduce the space occupied and provides different exercise modes.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rowing exercise machine, comprising:

a base frame, including a slidable seat;

a paddle unit, pivotally connected to the base frame;

a first rotating shaft, pivotally connected to the base frame in a first axial direction;

a paddle linkage unit, disposed on the base frame, the paddle linkage unit including a paddle linkage member, a paddle one-way driving wheel and a paddle reel, the paddle linkage member connecting the paddle unit and the paddle one-way driving wheel, the paddle one-way driving wheel being pivotally connected to the first rotating shaft, the paddle one-way driving wheel driving the first rotating shaft in a first rotational direction, the paddle one-way driving wheel being idle on the first rotating shaft in a second rotational direction, the paddle reel being connected to the paddle one-way driving wheel;

a resistance unit, disposed on the base frame, the resistance unit being connected to the first rotating shaft for providing a rotational resistance to the first rotating shaft;

a pull bar unit, disposed on the base frame;

a second rotating shaft, pivotally connected to the base frame in the first axial direction;

a pull bar linkage unit, disposed on the base frame, the pull bar linkage unit including a pull bar linkage member, a pull bar transmission wheel, a pull bar one-way wheel, a pull bar reel and a pull bar driving wheel, the pull bar transmission wheel being connected to the second rotating shaft, the pull bar one-way wheel being pivotally connected to the second rotating shaft, the pull bar one-way wheel driving the second rotating shaft in the first rotational direction, the pull bar one-way wheel being idle on the second rotating shaft in the second rotational direction, the pull bar reel being connected to the second rotating shaft, the pull bar driving wheel being connected to the first rotating shaft, the pull bar unit being connected to the pull bar transmission wheel through the pull bar linkage member;

wherein when a first operating force is applied to the paddle unit, the paddle one-way driving wheel and the first rotating shaft are driven to rotate in the first rotational direction, and the paddle reel accumulates a first return force; when the first operating force decreases or disappears, the first return force drives the paddle one-way driving wheel to be idling on the first rotating shaft in the second rotational direction;

wherein when a second operating force is applied to the pull bar unit, the pull bar transmission wheel, the pull bar one-way wheel, the second rotating shaft and the pull bar driving wheel are driven to rotate in the first rotational direction together with the first rotating shaft, and the pull bar reel accumulates a second return force; when the second operating force decreases or disappears, the second return force drives the pull bar one-way wheel to be idling on the second rotating shaft in the second rotational direction.

2. The rowing exercise machine as claimed in claim 1, wherein the paddle unit includes two paddles and two pivot bases, the two paddles each include a pivot end and a grip end opposite to the pivot end, the two pivot bases each include a swing arm, the swing arm has a swing arm end, the two pivot bases are pivotally connected to the base frame in the first axial direction, the two paddles are pivotally connected to the pivot bases in the second axial direction, and the second axial direction is perpendicular to the first axial direction.

3. The rowing exercise machine as claimed in claim 2, wherein the paddle linkage unit further includes two first driven wheels, the paddle one-way driving wheel includes two paddle one-way driving wheels, the two first driven wheels are pivotally connected to the base frame in the first axial direction, the two first driven wheels each include a first small wheel and a first large wheel, the paddle linkage member includes two first linkage members and two second linkage members, one end of each first linking member is connected to the corresponding swing arm end, another end of each first linkage member is wound around the corresponding first small wheel, one end of each second linkage member is wound around the corresponding first large wheel, and another end of each second linkage member is connected to the corresponding paddle one-way driving wheel.

4. The rowing exercise machine as claimed in claim 1, wherein the paddle reel includes a first casing, a paddle reel rotating shaft, a first scroll spring and at least one bolt, the first casing is fixed to the base frame, the paddle reel rotating shaft is rotatably connected to the base frame in the first axial direction, one end of the first scroll spring is fixed to the first casing, another end of the first scroll spring is fixed to the paddle reel rotating shaft, a connecting disc is provided on the paddle reel rotating shaft, the connecting disc has at least one circular hole, the paddle one-way driving wheel has at least one threaded hole corresponding to the circular hole, the bolt passes through the circular hole and is screwed to the threaded hole, and the first casing is covered with a first cover.

5. The rowing exercise machine as claimed in claim 1, wherein the pull bar unit is a pull bar, the pull bar linkage member includes two pull bar linkage members, one of the pull bar linkage members has one end connected to the pull bar and another end wound around the pull bar transmission wheel, and the other pull bar linkage member is connected to the pull bar one-way wheel and the pull bar driving wheel.

6. The rowing exercise machine as claimed in claim 1, wherein the pull bar reel includes a second casing and a second scroll spring, one end of the second scroll spring is fixed to the second casing, and another end of the second scroll spring is fixed to the second rotating shaft.

7. The rowing exercise machine as claimed in claim 1, wherein a first one-way bearing is disposed between the paddle one-way driving wheel and the first rotating shaft.

8. The rowing exercise machine as claimed in claim 1, wherein a second one-way bearing is disposed between the pull bar one-way wheel and the second rotating shaft.

9. The rowing exercise machine as claimed in claim 1, wherein the resistance unit includes a resistance driving wheel, a resistance connecting member and a resistance member, the resistance driving wheel is connected to the first rotating shaft, the resistance member is connected to the base frame, and the resistance connecting member connects the resistance driving wheel and the resistance member.

10. The rowing exercise machine as claimed in claim 9, wherein the resistance member is one of a magnetic resistance member, a friction resistance member, an air resistance member, a liquid resistance member, a motor and an electromagnetic brake resistance member.

* * * * *